United States Patent [19]

Mochida et al.

[11] 4,428,024

[45] Jan. 24, 1984

[54] ELECTRONIC DOOR LOCKING SYSTEM FOR AN AUTOMOTIVE VEHICLE

[75] Inventors: Haruo Mochida; Ken Miyamoto, both of Yokohama, Japan

[73] Assignee: Nissan Motor Company, Ltd., Kanagawa, Japan

[21] Appl. No.: 367,037

[22] Filed: Apr. 7, 1982

[30] Foreign Application Priority Data

Apr. 8, 1981 [JP] Japan ..... 56-49561[U]

[51] Int. Cl.³ ..... H01H 47/00

[52] U.S. Cl. ..... 361/172; 307/10 R; 307/10 AT; 340/63; 340/64; 340/825.31; 340/825.32; 70/278; 180/289

[58] Field of Search ..... 361/172; 307/10 R, 10 AT; 340/63, 64, 543, 825.31, 825.32; 70/262, 278; 180/289

[56] References Cited

U.S. PATENT DOCUMENTS

| | | | |
|---|---|---|---|
| 3,139,561 | 6/1964 | Madonna . | |
| 3,691,396 | 9/1972 | Hinrichs | 307/40 |
| 3,829,834 | 8/1974 | Frankland et al. | 340/149 R |
| 3,831,065 | 8/1974 | Martin et al. . | |
| 4,205,325 | 5/1980 | Haygood et al. | 307/10 R X |
| 4,240,516 | 12/1980 | Henderson et al. | 180/289 |
| 4,300,057 | 11/1981 | Batlle Crosas | 340/63 X |
| 4,342,024 | 7/1982 | Rossi | 340/64 |
| 4,383,242 | 5/1983 | Sassover et al. | 340/64 |

FOREIGN PATENT DOCUMENTS 2344424 10/1977 France .

*Primary Examiner*—Elliot A. Goldberg
*Assistant Examiner*—Derek Jennings
*Attorney, Agent, or Firm*—Lowe, King, Price & Becker

[57] ABSTRACT

An electronic door locking system for an automotive vehicle with which vehicle doors can be locked, by depressing a proper push-button type switch representative of a predetermined door-locking octal digit, only when an ignition key is not left in the ignition keyhole. Therefore, it is possible to lock vehicle doors without leaving the ignition key in the keyhole, with the result that the vehicle can be prevented from being stolen by a thief when parked. The electronic door locking system according to present invention includes a device for detecting the presence of the ignition key left in the ignition keyhole and outputting a signal to inhibit a door-locking command signal from being applied to a door lock actuating solenoid, in addition to the conventional electronic door locking system.

7 Claims, 1 Drawing Figure

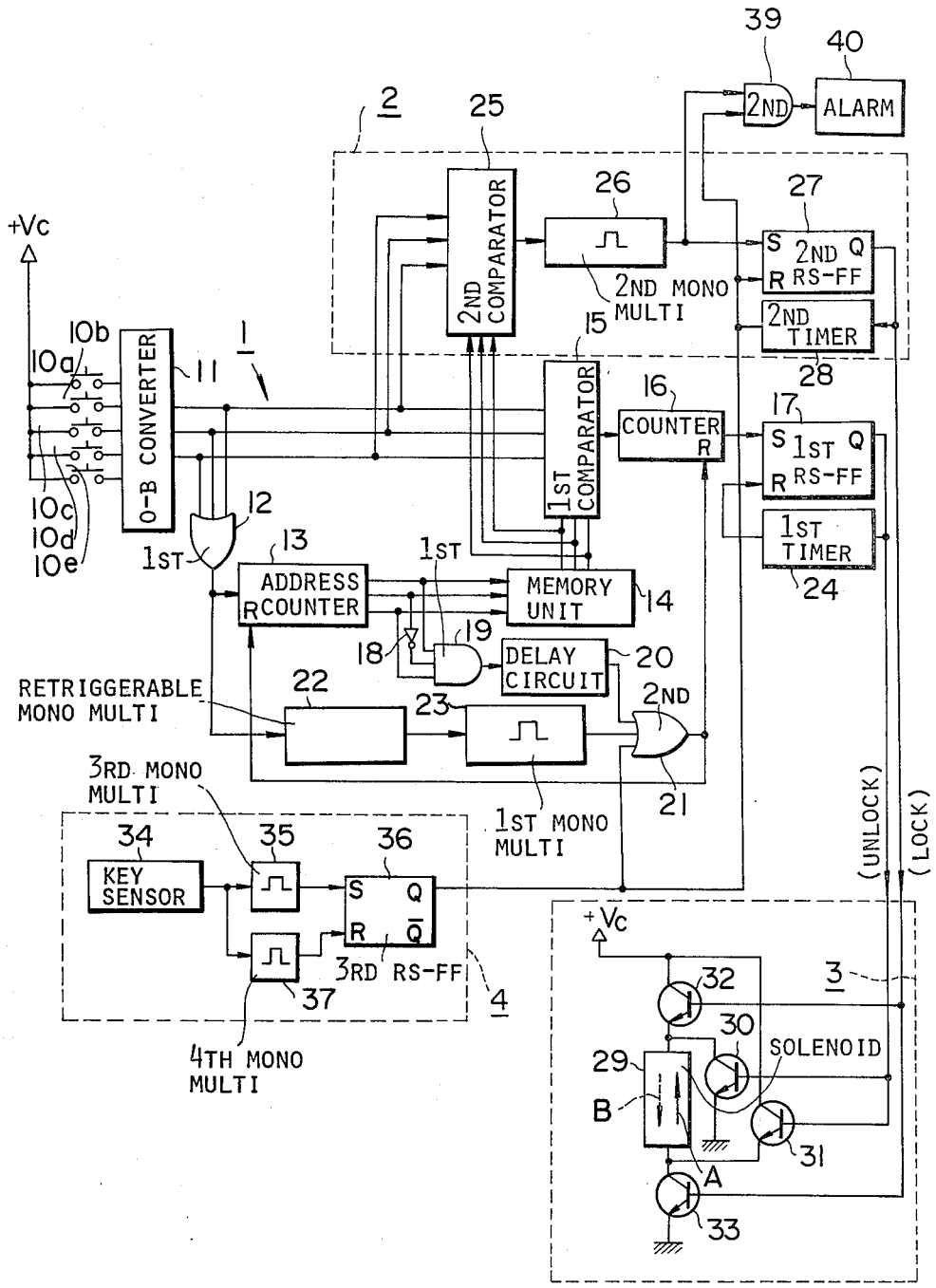
39
40
2ND
ALARM
2
25
2ND COMPARATOR
26
2ND MONO MULTI
27
S 2ND Q
R RS-FF
2ND TIMER
28
+Vc
10b
10a
10c
10d
10e
0-B CONVERTER
11
1
15
1ST COMPARATOR
16
COUNTER R
17
S 1ST Q
R RS-FF
1ST TIMER
24
12
1ST
13
ADDRESS COUNTER
1ST
MEMORY UNIT
14
18
19
DELAY CIRCUIT
20
RETRIGGERABLE MONO MULTI
22
23
2ND
21
1ST MONO MULTI
3RD MONO MULTI
34
KEY SENSOR
35
36
S Q
R Q̄
3RD RS-FF
37
4
4TH MONO MULTI
(UNLOCK)
(LOCK)
+Vc
32
3
30
SOLENOID
29
B
31
A
33

ELECTRONIC DOOR LOCKING SYSTEM FOR AN AUTOMOTIVE VEHICLE

BACKGROUND OF THE INVENTION

1. Field of the Invention

The present invention relates generally to an electronic push-button type door locking device for an automotive vehicle, and more particularly to an electronic door locking system by which vehicle doors can be locked or unlocked when the driver depresses a plurality of push-button type switches in accordance with a predetermined code.

2. Description of the Prior Art

The background of the present invention will be explained with respect to its application to the system used with an automotive vehicle.

As is well-known, there exists an electronic push-button type door locking system for an automotive vehicle, by which vehicle doors can be locked or unlocked when the driver depresses a plurality of push-button type switches installed at an appropriate position on the outside of an automotive vehicle in accordance with a predetermined code. When such an electronic vehicle door locking system as described above is used to lock or unlock the doors, since the vehicle doors can be locked or unlocked by the driver without using the ignition key, it is very convenient for the driver, in particular, when the vehicle is left parked.

In the above-mentioned electronic door locking system, however, since the vehicle doors can be locked from the outside of the vehicle without use of the ignition key, when the driver parks his vehicle, there exists the danger that he might leave his vehicle, after having locked the door by using the electronic push-button type door locking system, with the ignition key left inserted in the ignition keyhole.

In the case where the vehicle is left parked in the driver's own private parking space with the ignition key left in the ignition keyhole, there may be little chance of the vehicle's being stolen; however, in the case where the vehicle is left parked in public out of the driver's sight with the ignition key left in the ignition keyhole, since a thief can readily see whether or not the ignition key is left inserted in the ignition keyhole, there may be a chance that the thief will break the vehicle window to open the vehicle door even if the door is locked by the electronic push-button type door locking system, and may steal the vehicle by using the ignition key left in the keyhole.

SUMMARY OF THE INVENTION

With these problems in mind, therefore, it is the primary object of the present invention to provide an electronic door locking system for an automotive vehicle in which vehicle doors can be locked by depressing a plurality of push-button switches in accordance with a predetermined code only after the ignition key is removed from the ignition keyhole; that is, a door locking command signal is automatically disenabled when the ignition key is left in the ignition keyhole.

Therefore, in the electronic door locking system according to the present invention, even if the driver depress the push-button switches in accordance with the predetermined code, when the ignition key is in the ignition keyhole, the vehicle door cannot be locked, thus preventing the vehicle from being stolen when the vehicle is left parked with the ignition key left in the keyhole.

To achieve the above-mentioned object, the electronic door locking system for an automotive vehicle according to the present invention comprises, in particular, means for detecting the presence of an ignition key left in the ignition keyhole and outputting a signal to inhibit a door locking command signal, generated when the driver enters a predetermined door-locking digit code, from being applied to a door lock actuating member, in addition to the conventional electronic door locking system including a plurality of push-button switches, a octal-binary code converter, an address counter, a memory unit, comparators, a counter, reset-set flip-flops, etc.

BRIEF DESCRIPTION OF THE DRAWINGS

The features and advantages of the electronic door locking system for an automotive vehicle according to the present invention will be more clearly appreciated from the following description of the preferred embodiment of the invention taken in conjunction with the accompanying drawing in which;

The FIGURE is a schematic block diagram of an embodiment of the electronic door locking system according to the present invention.

DETAILED DESCRIPTION OF THE PREFERRED EMBODIMENTS

First, the circuit configuration of an embodiment of the electronic door locking system according to the present invention will be described hereinbelow with reference to the attached drawing.

The system according to the present invention can roughly be divided into four sections: a door unlocking command signal generating section 1, a door locking command signal generating section 2, a door lock/unlock actuating section 3, and an ignition key sensor section 4.

In the door unlocking command signal generating section 1, the reference numerals 10*a*–10*e* denote a plurality of push-button type switches arranged at an appropriate position on the outer surface of a vehicle door. To unlock vehicle doors, a specific sequence of numerals, such as the five digits "2-1-3-5-4" are used; while to lock the vehicle doors, a single specific numeral, such as the digit "2" (the first of the above five digits) is used. The reference numeral 11 denotes a octal-binary code converter (referred to as O-B converter hereinafter) for converting the octal code designated by the push-button switches 10*a*–10*e* into the corresponding three-bit binary code. The reference numeral 12 denotes a first OR gate for generating a H-voltage level output signal whenever the O-B converter 11 outputs a three-bit binary coded signal, and the reference numeral 13 denotes an address counter for generating an address-designating signal which is advanced incrementally by the H-voltage level signals from the OR gate 12.

In other words, when a first signal is inputted to the address counter 13 via the first OR gate 12, the counter 13 outputs a three-bit binary signal "001" to designate address No. 1 in the memory unit 14; when a second signal is inputted to the address counter 13 via the first OR gate 12, the counter 13 outputs a three-bit binary signal "010" to designate address No. 2 in the memory unit, and so on.

The reference numeral 14 denotes a memory unit such as a RAM or ROM in which the above-mentioned numerical code "2-1-3-5-4" is previously stored in the form of binary coded digits. The respective binary coded digits corresponding to the above-mentioned octal code "2-1-3-5-4" are read out sequentially in response to the address-designation signals outputted from the address counter 13. The reference numeral 15 denotes a first comparator for comparing the binary coded digits outputted from the O-B converter 11 with the ones read out from the memory unit 14 and outputting a H-voltage level signal whenever the digits agree, the reference numeral 16 denotes a counter for outputting a signal after the first comparator 15 has inputted the predetermined number of signals (five signals in this embodiment) consecutively thereto, and the reference numeral 17 denotes a first reset-set flip-flop (referred to as RS-FF hereinafter) for generating a door unlocking command signal when set by the output signal from the counter 16.

Further, the reference numeral 18 denotes an inverter, the reference numeral 19 denotes a first AND gate, the reference numeral 20 denotes a delay circuit, and the reference numeral 21 denotes a second OR gate. These elements serves to reset the counter 16 to a L-voltage level a fixed period of time after the predetermined octal unlocking code "2-1-3-5-4" has been inputted to the O-B converter 11 by the driver via the push-button switches 10*a*–10*e*.

In more details since the three-bit address signals from the address counter 13 are applied to the respective input terminals of the first AND gate 19, when the last digit of the octal unlocking code is inputted, the address counter 13 outputs a three-bit binary signal "101" (5 in octal code) to designate address No. 5 in the memory unit 14. Therefore, since this three-bit signal is inputted to the first AND gate 19 via the three independent input terminals, the first AND gate 19 outputs a H-voltage level signal, because "0" of the 2nd input terminal is applied to the first AND gate 19 after having been inverted into "1" through the inverter 18. This H-voltage level output signal from the first AND gate 19 is inputted to the delay circuit 20, and, after a fixed period has elapsed, the output signal from the delay circuit 20 resets the counter 16 through the second OR gate 21.

Furthermore, the reference numeral 22 denotes a retriggerable monostable multivibrator which can be retriggered when a H-voltage level signal is inputted thereto within a predetermined period of time but automatically reset to a L-voltage level when no H-voltage level signal is inputted thereto within a predetermined period of time. The reference numeral 23 denotes a first monostable multivibrator which is automatically reset to a L-voltage level after a H-voltage level is kept for a predetermined period of time when triggered. These elements serve to reset the counter 16 to a L-voltage level when the push-button switches are not depressed consecutively, that is, when the switches are depressed intermittently with delays exceeding a predetermined time interval. If the counter 16 is reset before outputting a signal, the first RS-FF will not be set and so will not output a door unlocking signal. In more detail, the output signal from the first OR gate 12 is applied to the retriggerable monostable multivibrator 22 and the first monostable multivibrator 23 is so designed as to be triggered by the trailing edge of the output signal from the retriggerable monostable multivibrator 22. Therefore, in the case where the O-B converter 11 outputs binary coded signals consecutively to the trigger terminal of the retriggerable monostable multivibrator 22, the multivibrator 22 is repeatedly triggered to a H-voltage level without dropping to the L-voltage level as long as the binary coded signals are inputted, therefore, the first monostable multivibrator 23 is not triggered into a H-voltage level (because the first multivibrator 23 can be triggered only when the retriggerable multivibrator 22 changes to a L-voltage level), so that the counter 16 is not reset through the second OR gate 21. In the case where the O-B converter 11 outputs binary coded signals to the trigger terminal of the retriggerable monostable multivibrator 22 intermittently with delays exceeding a predetermined time interval (determined by setting a time constant of the CR circuit in the multivibrator 22), since the retriggerable monostable multivibrator 22 is automatically reset to a L-voltage level before the next binary coded signal from the first OR gate 12 triggers it, the trailing edge of the output signal therefrom triggers the first monostable multivibrator 23, and as a result the counter 16 is reset via the second OR gate 21 to the original condition before it can output a H-level signal to the first RS-FF 17.

Furthermore, after being set, the first RS-FF 17 for outputting a door unlocking signal is reset after a predetermined period of time by an output signal from a first timer 24 which starts in response to the H-voltage level output signal from the first RS-FF 17.

In the door locking command signal generating section 2, the reference numeral 25 denotes a second comparator, the reference numeral 26 denotes a second monostable multivibrator, and the reference numeral 27 denotes a second RS-FF.

To lock the vehicle doors, for instance, the first digit "2" of the five consecutive unlocking numerals "2-1-3-5-4" is depressed by the driver via one of the push-button switches 10*a*–10*e*.

When a push-button switch corresponding to "2" is depressed, the O-B converter 11 outputs the corresponding binary coded signals "010". When this first signal is inputted to the address counter 13 via the first OR gate 12, the counter 13 outputs a three-bit binary signal "001" to designate address No. 1 in the memory unit 14. Therefore, a first stored code signal is read out from the memory unit 14 and this signal is compared with the output signal from the O-B converter 11 by the second comparator 25. When the signals agree, the output signal from the comparator 25 triggers the second monostable multivibrator 26. As a result, the second RS-FF 27 is set by the output signal from the second monostable multivibrator 26, in order to generate a door locking signal. After being set, the second RS-FF 27 for outputting a door locking signal is reset after a predetermined period of time by an output signal from a second timer 28 which starts in response to the H-voltage level output signal from the second RS-FF 27.

In the door lock/unlock actuating section 3, the reference numeral 29 denotes a solenoid and the reference numerals 30–33 denote transistors configuring a switching circuit.

The solenoid 29 is used for locking or unlocking the vehicle doors according to the direction of current flowing therethrough. In more detail, in the case where the first RS-FF 17 outputs a door unlocking command signal, since current is applied to the base of the first transistor 30, the first transistor 30 is turned on. In addition, since current is also applied to the base of the second transistor 31, the second transistor 31 is turned on so that a solenoid energizing current flows from the positive terminal +Vc, through the second transistor 31, the solenoid 29, and the first transistor 30 to ground in the direction of arrow A, so that the solenoid 29 is energized to unlock the vehicle doors. In the case where the second RS-FF 27 outputs a door locking command signal, since current is applied to the base of the fourth transistor 33, the fourth transistor 33 is turned on. In addition, since current is also applied to the base of the third transistor 32, the third transistor 32 is turned on so that a solenoid energizing current flows from the positive terminal +Vc, through the third transistor 32, the solenoid 29, and the fourth transistor 33 to ground in the direction of arrow B, so that the solenoid 29 is energized to lock the vehicle doors.

In the ignition key sensor section 4, the reference numeral 34 denotes a key sensor for outputting a H-voltage level signal where the ignition key is left inserted in the ignition keyhole, the reference numeral 35 denotes a third monostable multivibrator, the reference numeral 36 denotes a third RS-FF, and the reference numeral 37 denotes a fourth monostable multivibrator.

In the case where the ignition key is inserted in the keyhole, the key sensor 34 outputs a H-voltage level signal to trigger the third monostable multivibrator 35, therefore, the third RS-FF 36 is set to a H-voltage level output. Since the output terminal Q of this third RS-FF 36 is connected to the reset terminal R of the second RS-FF 27, the RS-FF 27 is forcedly reset by this signal from the third RS-FF 36, so that the RS-FF 27 cannot output a door locking command signal, even if an appropriate push-button switch is depressed to lock the door, if the ignition key is left in the ignition keyhole.

The fourth monostable multivibrator 37 is triggered when the ignition key is extracted from the keyhole, that is, when the output signal from the key sensor 34 returns to a L-voltage level, so that the third RS-FF 36 is reset to prevent outputting a reset signal to the second RS-FF 27, that is, the second RS-FF 27 can now output a door locking command signal if the appropriate push-button switch is depressed.

The reference numeral 39 denotes a second AND gate and the reference numeral 40 denotes an alarm device 40.

In the case where a door lock signal is inputted via the push-button switch 10 with the ignition key in the keyhole, since both the signals from the second monostable multivibrator 26 and from the third RS-FF 36 are applied to the second AND gate 39, the AND gate 39 outputs a signal, so that the alarm device 40 such as a buzzer or chime is activated to indicate to the driver that the ignition key is still in the keyhole and therefore the door lock is inoperative.

The operation of the electronic door locking system for an automotive vehicle according to the present invention will be described hereinbelow.

In order to unlock the vehicle door, first a sequence of predetermined octal digits (2-1-3-5-4) are inputted by the driver via the switches 10*a*–10*e*; the O-B converter outputs a series of three-bit binary numbers (010-001-011-101-100) corresponding to the octal ones; whenever the O-B converter outputs a three-bit binary signal, the address counter 13 is advanced incrementally via the first OR gate 12 to output an address designation signal from No. 1 to No. 5, respectively; in response to these address-designation signals the memory unit 4 outputs the three-bit binary codes previously stored in the designated memory addresses; these numbers are compared with the ones outputted from the O-B converter by the first comparator 15; if the numbers match, the comparator 15 outputs a H-level signal; after a series of binary unlocking numbers have been successfully compared, the counter 16 outputs a signal to set the first RS-FF 17, so that a door unlocking signal is outputted.

Further, when the last unlocking number is inputted and therefore the address-designation signal No. 5 (101) is outputted from the address counter 13, the counter 16 is reset after a predetermined period of time determined by the delay circuit 20. If the unlocking numbers are inputted intermittently with delays exceeding a predetermined time interval, the counter 16 is also reset through the retriggerable monostable multivibrator 22 and the first monostable multivibrator 23.

In the case where the door is intended to be locked from the outside the vehicle by depressing the appropriate push-button switch 10*a*–10*e* with the ignition key left inserted in the keyhole, the key sensor 34 outputs a H-voltage level signal indicative of the presence of the key, and thereby the RS-FF 36 is set by a trigger signal from the monostable multivibrator 35. Therefore, the reset terminal R of the second RS-FF 27 goes to a H-voltage level, that is, to the rest state, compulsorily. As a result, even if the proper push-button switch 10*a*–10*e* is depressed to lock the door, no locking signal will be outputted, disabling door lock operation. At the same time, the H-voltage level output signal of the AND gate 39 actuates the alarm device 40, indicating to the driver that the ignition key is still in the keyhole and thereby the doors can not be locked.

Therefore, the driver will notice that the ignition key is in the keyhole. If the key is removed the key sensor 34 outputs a L-voltage level signal to reset the RS-FF 36.

Under these conditions, when one of the push-button switches 10*a*–10*e* is depressed, binary coded signals are applied from the O-B converter 11 to the second comparator 25; a code stored in the memory unit 14 is read out when the address counter 13 designates address No. 1; the second comparator 25 outputs a signal when the signals match in order to trigger the second monostable multivibrator 26; a locking signal is outputted when the second RS-FF 27 is set. The transistors 32 and 33 are turned on in response to the locking signal, and current passes through the solenoid 29 in the direction of arrow B to lock the vehicle door.

In the door locking operation, although the first comparator 15 also outputs a signal to advance the counter 16, since only one of the push-button switches 10*a*–10*e* has been depressed, the retriggerable multivibrator 22 is reset after a predetermined period of time and the counter 16 is reset, so that the unlocking command signal is not generated.

As described above, in the electronic door locking system according to the present invention, since the door locking command signal is automatically disenabled when the ignition key is in the keyhole, the driver must remove the ignition key from the keyhole in order to lock his vehicle, with the result that it is possible to securely prevent the vehicle from being stolen.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. An electronic door locking system for an automotive vehicle for locking or unlocking vehicle doors without an ignition key which comprises:

(a) a plurality of switches for outputting at least one predetermined door-locking octal coded digit and a sequence of predetermined door-unlocking octal coded digits;

(b) a octal-binary code converter connected to a plurality of said switches for converting the octal coded digits inputted from said switches into the corresponding binary coded digits;

(c) an address counter connected to said octal-binary code converter for counting up a plurality of the binary-coded signals outputted from said octal-binary code converter whenever one of said switches is depressed and outputting an address-designation signal in response to the number of signals outputted from said octal-binary code converter;

(d) a memory unit connected to said address counter for outputting a previously stored binary coded signal in response to the address-designation signal outputted from said address counter;

(e) a first comparator connected to said octal-binary code converter and said memory unit for outputting a signal when one of the binary coded door-unlocking signals outputted from said octal-binary code converter agrees with one of the binary coded door-unlocking signals outputted from said memory unit in response to the respective address-designation signal outputted from said address counter;

(f) a counter connected to said first comparator for outputting a signal when said first comparator outputs the predetermined number of binary coded signals;

(g) a first reset-set flip-flop connected to said counter for outputting a door unlocking command signal when said counter outputs the signal;

(h) a second comparator connected to said octal-binary code converter and said memory unit for outputting a signal when at least one binary coded door-locking signal outputted from said octal-binary code converter agrees with at least one binary coded door-locking signal outputted from said memory unit in response to the address-designation signal outputted from said address counter, (i) a second reset-set flip-flop connected to said second comparator for outputting a door locking command signal when said second comparator outputs the signal; and (j) a door lock/unlock actuating solenoid connected to said first and second reset-set flip-flops for unlocking the vehicle doors when said first reset-set flip-flop is set and locking the vehicle doors when said second reset-set flip-flop is set; and (k) means for detecting the presence of the ignition key left in an ignition keyhole and outputting a reset signal to said second reset-set flip-flop to inhibit the door-lock command signal from being inputted from said second reset-set flip-flop to said door lock/unlock actuating solenoid;

whereby the vehicle doors cannot be locked even when at least one predetermined door-locking octal coded digit is inputted to the system via a plurality of said switches, in the case where the ignition key is left inserted in the ignition keyhole.

2. An electronic door locking system for an automotive vehicle for locking or unlocking vehicle doors without use of an ignition key as set forth in claim 1, wherein said means for detecting the presence of the ignition key left in an ignition keyhole and outputting a reset signal to said second reset-set flip-flop comprises:

(a) a key sensor for detecting the presence of the ignition key left inserted in an ignition keyhole and outputting a signal corresponding thereto;

(b) two monostable multivibrators connected to said key sensor, one of which is triggered when said key sensor outputs a signal and the other of which is triggered when said key sensor outputs no signal; and (c) a third reset-set flip-flop the set terminal of which is connected to one of said two monostable multivibrators, the reset terminal of which is connected to the other of said two monostable multivibrators, and an output terminal of which is connected to said reset terminal of said second reset-set flip-flop, said second reset-set flip-flop being reset when said third reset-set flip-flop outputs a signal, that is, when said key sensor outputs a signal, whereby no door-locking command signal is outputted from said second reset-set flip-flop to said door lock/unlock actuating solenoid when the ignition key is in the ignition keyhole.

3. An electronic door locking system for an automotive vehicle for locking or unlocking vehicle doors without use of an ignition key as set forth in either claim 1 or 2, which further comprises:

(a) an AND gate one input terminal of which is connected to said second comparator and the other input terminal of which is connected to said third reset-set flip-flop, said AND gate outputting a signal when said second comparator outputs a signal, that is, when at least one predetermined door-locking octal coded digit is inputted to the system via a plurality of said switches and when said third reset-set flip-flop outputs a signal, that is, when said key sensor detects the presence of the ignition key left in the ignition keyhole; and (b) an alarm device connected to an output terminal of said AND gate for producing an audible alarm in response to the signal from said AND gate, whereby an audible alarm can be produced when the door is locked with the ignition key left in the ignition keyhole.

4. An electronic door locking system for an automotive vehicle for locking or unlocking vehicle doors without use of an ignition key as set forth in claim 3, wherein said alarm device is a buzzer.

5. An electronic door locking system for an automotive vehicle for locking or unlocking vehicle doors without use of an ignition key as set forth in claim 3, wherein said alarm device is a chime.

6. An electronic door locking system for an automotive vehicle for locking/unlocking vehicle doors without an ignition key which comprises:

(a) means for inputting a sequence of unlocking coded numbers and at least one locking coded number and outputting signals corresponding thereto;

(b) means for generating an unlock command signal in response to a sequence of unlocking coded numbers outputted from said means for inputting coded numbers;

(c) means for generating a lock command signal in response to at least one locking coded number outputted from said means for inputting coded numbers;

(d) means for unlocking the vehicle doors in response to the unlock command signal outputted from said means for generating an unlock command signal and locking the vehicle doors in response to the lock command signal outputted from said means for generating a lock command signal; and (e) means for sensing the presence of an ignition key in an ignition keyhole and preventing the generation of the lock command signal when an igniton key is in an ignition keyhole.

7. An electronic door locking system for an automotive vehicle for locking/unlocking vehicle doors without an ignition key as set forth in claim 1, which further comprises an alarm device for generating a sensible alarm when said sensing means senses the presence of an ignition key in an ignition keyhole and at least one coded number is inputted in the proper sequence for generating the lock command signal.

* * * * *